US007780008B2

(12) United States Patent
Portier

(10) Patent No.: US 7,780,008 B2
(45) Date of Patent: Aug. 24, 2010

(54) SEALED ASSEMBLY FOR STORAGE AND DISTRIBUTION WITH DISCHARGE CONTROL FOR SOLID PHARMACEUTICAL PRODUCTS

(75) Inventor: Benoit Portier, Bourges (FR)

(73) Assignee: Airsec S.A.S., Choisy le Roi (FR)

( * ) Notice: Subject to any disclaimer, the term of this patent is extended or adjusted under 35 U.S.C. 154(b) by 457 days.

(21) Appl. No.: 11/751,280

(22) Filed: May 21, 2007

(65) Prior Publication Data

US 2007/0267304 A1 Nov. 22, 2007

Related U.S. Application Data

(60) Provisional application No. 60/816,646, filed on Jun. 27, 2006.

(30) Foreign Application Priority Data

May 19, 2006 (FR) ..... 06 04538
May 16, 2007 (WO) ..... PCT/FR2007/000831

(51) Int. Cl.
*B65D 83/04* (2006.01)

(52) U.S. Cl. ..... 206/540; 220/254.1; 220/255; 221/306

(58) Field of Classification Search ..... 206/528, 206/540; 220/254.1, 255, 256.1, 258.1, 258.2, 220/254.7, 787, 789, 801; 221/303, 306, 221/307, 309; 215/294, 358
See application file for complete search history.

(56) References Cited

U.S. PATENT DOCUMENTS 697,798 A * 4/1902 Brooks ..... 215/14
2,173,046 A 9/1939 Smith
2,918,167 A 12/1959 Lowen
3,435,988 A 4/1969 Jonas et al.
3,516,536 A * 6/1970 Ino ..... 206/540
3,517,855 A 6/1970 Hillis
3,581,934 A 6/1971 Sciascia
4,228,920 A 10/1980 Burton
4,240,564 A 12/1980 Pritchard
4,266,690 A 5/1981 Holmes et al.
4,530,447 A * 7/1985 Greenspan ..... 221/288

(Continued)

FOREIGN PATENT DOCUMENTS

EP 756567 10/1998

(Continued)

OTHER PUBLICATIONS

Office Action dated Feb. 20, 2009 with respect to U.S. Appl. No. 10/547,483.

*Primary Examiner*—J. Gregory Pickett
(74) *Attorney, Agent, or Firm*—Scott R. Cox

(57) ABSTRACT

The present invention relates to an assembly for the storage and distribution of solid loosely packed products unit by unit. The assembly generally comprises a storage container, a sealing means and a discharge control device inserted into the neck of the container to permit the passage of the products to be distributed. Inviolability and sealing of the container are achieved by means of a peelable heat seal, sealed thermally onto at least one surface defined by an annular, peripheral surface of the neck of the container and/or all or part of an upper surface of the device and/or a surface of a distribution opening.

28 Claims, 6 Drawing Sheets

U.S. PATENT DOCUMENTS

| | | | | |
|---|---|---|---|---|
| 4,573,632 | A * | 3/1986 | Scheeren | 220/657 |
| 4,653,668 | A * | 3/1987 | Gibilisco et al. | 221/298 |
| 4,782,981 | A | 11/1988 | Schuster | |
| 5,505,308 | A | 4/1996 | Elkmeier et al. | |
| 5,736,616 | A | 4/1998 | Ching et al. | |
| 5,788,064 | A | 8/1998 | Sacherer et al. | |
| 6,334,974 | B1 | 1/2002 | Chen | |
| 6,497,845 | B1 | 12/2002 | Sacherer | |
| 6,619,494 | B1 * | 9/2003 | Brozell et al. | 215/231 |
| 2003/0010668 | A1 | 1/2003 | Taskis et al. | |
| 2005/0061706 | A1 * | 3/2005 | Reynolds et al. | 206/540 |
| 2006/0169603 | A1 | 8/2006 | Lancesseur et al. | 206/204 |
| 2009/0014463 | A1 * | 1/2009 | Brozell et al. | 221/288 |

FOREIGN PATENT DOCUMENTS

| | | | |
|---|---|---|---|
| EP | 1799581 | B9 | 6/2007 |
| GB | 539891 | | 9/1941 |
| GB | 1074165 | | 6/1967 |
| GB | 2092108 | A * | 8/1982 |
| GB | 2210603 | A | 6/1989 |
| JP | 09315455 | A | 12/1997 |
| JP | 2003118758 | A | 4/2003 |
| WO | WO9409084 | A1 | 4/1994 |
| WO | WO9851758 | A1 | 11/1998 |
| WO | WO9948963 | A2 | 9/1999 |
| WO | WO2004024593 | A1 | 3/2004 |
| WO | 2004/080366 | | 9/2004 |

* cited by examiner

SEALED ASSEMBLY FOR STORAGE AND DISTRIBUTION WITH DISCHARGE CONTROL FOR SOLID PHARMACEUTICAL PRODUCTS

CROSS-REFERENCE TO RELATED APPLICATIONS

This patent application claims priority to French Application No. 06/04538, filed May 19, 2006, U.S. Ser. No. 60/816,646 filed Jun. 27, 2006, and to PCT Application No. PCT/FR2007/000831, filed May 16, 2007, the contents of which are incorporated herein by reference in their entireties.

BACKGROUND OF THE INVENTION

1. Field of the Invention

The present invention relates generally to an assembly for the storage and controlled distribution of loosely packed solid products to be distributed preferably unit by unit, where the inviolability and sealed closure of the latter are ensured prior to the first opening by a heat seal.

More particularly, the present invention relates to an assembly for the storage and controlled distribution of loosely packed solid products, preferably to be distributed unit by unit, comprising a container such as a flask, a discharge control device inserted into the neck of the container, an inviolable heat seal that is sealed prior to the first opening and a means for closing the assembly. The kinds of products packed loosely in this way can be, for example, pharmaceutical products such as tablets, dragees, pills, lozenges, pastilles, granules and capsules of all shapes and sizes, whose greatest dimension is either the diameter or the length.

A storage and distribution assembly of this type is designed to avoid several products being discharged unintentionally at once during the use of this kind of packaging by the final user, which is typically a consumer of the products.

2. Description of Related Art

Numerous assemblies comprising containers and discharge control devices having a specifically shaped outlet opening and that fit onto various different types of containers are described in the technical literature, in particular in patent applications and/or published patents.

Thus for example, the document EP 756567 describes a type of packaging designed for medicines that is provided with a system for the distribution of the medicines in tablet form.

A container of this kind for tablets comprises a storage compartment able to hold a specific volume of tablets, the storage compartment being in communication with the exterior of the container via a distribution device and one or more distribution passages comprising one or more distribution openings.

The distribution device can be shaped so as a form an integral part of the body of the container or conversely it can be designed as a separate adapter for the container, being attached to the body of the container to form the packaging. Furthermore, such an adapter can comprise a compartment operating as a storage chamber for a generally pulverulent desiccating agent that protects the tablets contained in the packaging from the ambient humidity of the packaging. A membrane that is porous to humidity retains the pulverulent desiccating agent and enables the humidity contained in the tablets stored in the body of the container and/or the internal humidity present in the container to be absorbed into the desiccating material.

The container equipped with its distribution device, which can be considered to be a discharge control, is closed by means of a stopper. The container and its stopper are designed together to cooperate with one another but are independent from the distribution device.

There are situations however, where the sealed and definitive closure of the container equipped with its discharge control cannot be achieved prior to its first opening in a effective manner by any other technique than heat sealing, that is by means of a heat seal made from a sheet of aluminium coated with polymer film that is able to be sealed by induction onto the only periphery of the neck of the container. This particular situation arises when the container is a type of flask, a small bottle with a large opening or neck, also in the case of a jar.

Sealing by using a peelable aluminium heat seal is a well known technique, which is simple to achieve and has advantages in that its temperature increases rapidly, the sealing temperatures can be controlled, subject to using thermoplastic coatings on the aluminium heat seal with the capacity to adhere onto the surface on which the heat seal is intended to be attached. The sealing surfaces can be very different in nature and made of materials such as glass or plastic. Glass flasks are effectively standard for packaging pharmaceutical products since they are transparent and widely available. However, other plastic materials can also be made into containers, such as flasks or jars, by techniques used in the plastic industry such as injection-blow moulding or extrusion-blow moulding. These are often preferably transparent materials such as polyesters or polycarbonates. Other materials are also possible such as polyethylenes or polypropylenes. The necks of these containers form the sealing surfaces.

By using a peelable heat seal as a means for sealing the container it is possible to achieve an absolute seal prior to the first opening, without having to resort to using separate gaskets and inviolability means, as the sealed and peelable heat seal performs this dual function.

However, once a device for controlling the discharge of the products to be distributed is fitted onto a container it is no longer possible to seal the neck of the container equipped with a distribution device of this kind, since the latter is generally arranged as a superstructure relative to the plane of the neck of the container. Moreover, the discharge control device has to be installed after filling the container at high speed with loosely packed solid products, in particular pharmaceuticals, and prior to the heat sealing of the container, which makes the heat sealing operation unlikely.

It can be observed that the discharge control devices of the prior art that fit onto containers such as flasks or jars do not produce results that are sufficiently satisfactory with regard to their capacity to integrate the heat sealing function by using a sealable heat seal.

For this reason it seems that the conditions for producing a heat seal of this kind with discharge control devices of the prior art are complex and difficult to automatise for mass production required by such packaging systems.

SUMMARY OF THE INVENTION

A problem posed by the art was therefore to design an assembly for the storage and distribution of unitary solid products, packed loosely, equipped not only with a discharge control device for the distribution, preferably unit by unit, of the products, but also with means that make it possible to ensure the sealing of the assembly in a definitive and sealed manner after filling by using a thermally sealed heat seal.

Therefore, the present invention relates to an assembly for the storage and controlled distribution of unitary products.

The assembly comprises a container for storing the products loosely, a means for closing the container and a discharge control device for the distribution of the products that is provided with an upper surface and a lower surface. The device permits the passage of the products to be distributed from the interior to the exterior of the container and comprises the following components:

- an entry opening on its lower surface;
- a guiding surface for the products to be distributed between a lower surface and an upper surface;
- a distribution opening on the upper surface;
- a means for fixing the device onto the container;

Wherein, a) the discharge control device is inserted into the container so that at least one part of its upper surface is at most flush with an upper peripheral surface of the neck of the container forming the sealing plane, or bears against the peripheral surface of the neck by means of a supporting means, the upper surface of which forms a sealing plane;

b) the discharge control device is attached to the container via a heat seal sealed onto at least one of sealing surface which is defined by:

- the upper peripheral surface of the neck of the container; and/or
- all or part of the upper surface of the device; and/or
- a peripheral surface of the distribution opening of the device.

Furthermore, the present invention relates to the use of a sealed assembly for storage and distribution for packaging solid products, in particular of a pharmaceutical nature.

BRIEF DESCRIPTION OF THE DRAWINGS

The invention is explained in more detail in the following description of the figures with reference numbers, where the figures illustrate a sealed storage and distribution assembly according to the present invention in an illustrative and non-restrictive manner.

Figure 1:
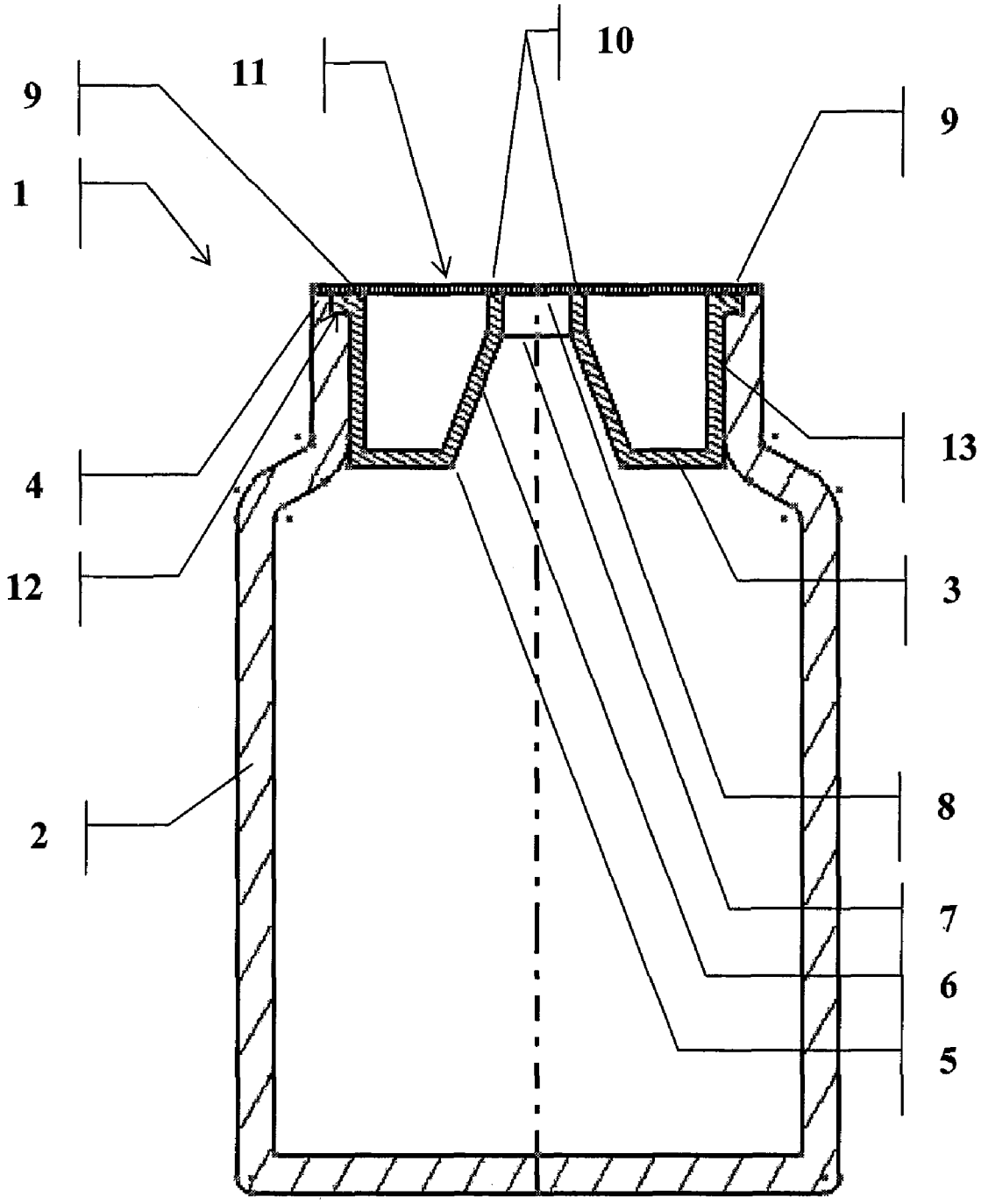
FIG. 1 shows a cross section of the sealed assembly comprising the storage container and discharge control device, in a structure with thin walls, according to the invention, fitted onto its container at the level of the neck of the container, where the heat seal has been carried out on the only concentric surfaces corresponding to the main distribution opening and the upper surface of the flange, as well as on the available surface of the neck of the container.

Additional objects, features and advantages of the invention will be set forth in the description which follows, and in part, will be obvious from the description, or may be learned by practice of the invention. The objects, features and advantages of the invention may be realized and obtained by means of the instrumentalities and combinations particularly pointed out in the appended claims.

DETAILED DESCRIPTION OF A PREFERRED EMBODIMENT

According to the present invention, an assembly for storage and distribution comprises a container, a discharge control device having an upper surface and a lower surface and a peripheral surface between these two surfaces, a main distribution opening, the device being inserted into the neck of the container for which it is designed. Inviolability and the seal of the assembly are ensured by a heat seal, thereafter the seal is ensured after a first opening by means of closure such as a reusable stopper/cover.

In the following description of one exemplary embodiment of the present invention:

- the upper surface of the device can be plane or formed from several parallel planes connected together or can be concave or convex.
- the heat seal is sealed onto at least one of the sealing surfaces which must be almost plane and almost level, i.e. preferably in the same plane.

The upper peripheral surface of the neck of the container can advantageously form a first plane which becomes the first sealing surface. At least one section almost plane with the upper surface of the device and more preferably the upper peripheral surface of the device can advantageously form a second plane which becomes the second sealing surface. The almost plane peripheral surface of the main distribution opening forms a third plane which can be a third sealing surface.

These three planes can be merged or parallel as desired. Any two of them can be merged if desired for any reason. The third plane can optionally be parallel so that the different structures of the device according to the present invention can be taken into consideration.

Advantageously at least one section of the upper surface of the device is at most flush with the upper peripheral surface of the neck of the container or bears against the peripheral surface of the neck by way of a supporting means, which can be a flange.

The discharge control device typically comprises an entry opening positioned on its lower surface, at least one guiding surface, with or without an line of symmetry, the surface of which can be extendable or non-extendable and an outlet opening which opens into the main distribution opening or constitutes the main distribution opening, the device having a means for securing onto the connected container.

The discharge control device belonging to the assembly according to the invention can be designed to be solid, for example in the form of a solid stopper, or as a structure with thin walls, both of which can be achieved for example, by means of plastics technology.

The discharge control device also can comprise, if it has a solid structure, an external peripheral surface, preferably cylindrical, or in the case of a structure with thin walls a peripheral skirt, preferably cylindrical, such that the surface or skirt on which the securing means are placed make it possible to assemble the device onto the container in a definitive and sealing manner.

The discharge control device typically has a continuous upper surface in the case of a solid structure or an upper surface formed from parallel planes connected together. This gives the appearance of concentric surfaces separated from one another. Preferably like concentric rings in the case of a structure with thin walls or even a concave or convex upper surface can be employed wherein each of the surfaces preferably has the ability to mount a peelable heat seal that can be sealed thermally, preferably by induction, over all or part of these surfaces, possibly running over the surfaces so as to be able to be sealed onto the neck of the container and to sealingly encase the assembly for storage and controlled distribution.

Entry Opening:

A suitable discharge control device for an assembly for storage and distribution according to the present invention generally comprises an entry opening on its lower surface opening into the guiding surface.

The entry opening of the guiding surface can, for example, have a circular, elliptical or polygonal profile, following the profile of the container. It is however preferably circular, as this shape is generally easier to machine. This profile also preferably corresponds with the internal profile of the neck of the container.

Guiding Surface

A discharge control device suitable for an assembly for storage and distribution according to the present invention generally also comprises a surface for guiding the products to be distributed, upstream of the main distribution opening.

Whatever type of structure is chosen, the guiding surface is preferably in the form of a wall delimiting a hollow volume with a spherical surface such as cap or a spherical, truncated, truncated cylindrical, truncated parabolic, truncated hyperbolic surface, the surfaces being concave with a rectilinear or oblique revolution, i.e. formed by a rectangular line or by a curved line.

The thus defined hollow volume has a height and a base, where the relationship between the height and the dimension of the base can be very low, even zero in the extreme case of a plane guiding surface.

In the case of a conical guiding surface, the angle at the summit of the cone can advantageously be between 30° and 180°—and preferably between 45° and 135°.

The guiding surface forming the wall is generally open at both ends. One of the openings, the largest, is preferably oriented towards an interior section of the container and forms the entry of the device for the products to be distributed. The other opening opens into or forms the main opening for distributing and controlling the discharge of the products, due to its specifically created shape.

Thus, it is generally possible to consider any geometric shape for the guiding surfaces. This makes it possible to pass from an internal section of the neck of the container to an internal section of the main distribution opening and to position the opening in an advantageous manner relative to the axis of the container.

In one particular and extreme design, the guiding surface can be a plane surface comprising the main distribution opening.

Main Distribution Opening:

According to the invention, the storage and distribution assembly comprises at least one distribution opening and generally at least one main distribution opening on the upper surface of the discharge control device permitting the passage of the products to be distributed (unit by unit if desired) from the interior to the exterior of the container.

The guiding surface opens into the main distribution opening of the device and/or with its small open end can form the main distribution opening itself.

The main distribution opening can have any various different profile(s), and is preferably circular, elliptical or polygonal, and/or can have a completely different shape depending on the shape and the size of the products to be distributed. This opening is advantageously shaped to permit the passage of a single product at a time. Thus, if the main distribution opening is circular, its diameter can generally be close to the length or diameter of the product to be distributed.

The main distribution opening can be positioned at the level of the plane of the upper peripheral surface of the discharge control device or be set back from the latter, i.e. below the level of the plane formed by the upper peripheral surface of the device, as a superstructure relative to the plane, or can be positioned in any desired manner.

The main distribution opening is preferably positioned in the center, that is in a center line of the discharge control device. However, in other embodiments, the main distribution opening can be positioned outside the line of symmetry of the discharge control device, for example at the periphery or at any other point of the upper surface of the device.

The main distribution opening preferably defines a peripheral plane surface creating the third plane which can if necessary form the third sealing surface.

The fact that the main distribution opening can be set back in relation to the plane of the upper peripheral surface of the discharge control device, means that free space can be created between the upper peripheral surface of the device forming the second sealing surface that receives the heat seal and the plane peripheral surface of the main distribution opening. This makes it possible to connect an additional inviolability system or a child protection system to the opening or other design component if desired for any reason.

Means for Fixing the Discharge Control Device into the Neck of the Container:

The discharge control device belonging to the storage and distribution assembly according to the present invention also preferably comprises a means for securing onto the internal surface of the container and/or the neck of the container onto which it is fitted.

Preferably, the securing means is positioned on the external peripheral surface of the device in the case of a solid structure or on the peripheral skirt in the case of a structure with thin walls.

Various different securing means can be used such as for example a force fit, a clipping connection with notch and groove on one or other of the existing surfaces, differential thermal shrinkage, a screw connection, or a catching connection, or any other desired securing means that would effectuate the task, etc. However, a preferred means for securing comprises utilizing a force fit between the preferably cylindrical external surface of the discharge control device and the preferably cylindrical internal surface of the neck of the container, i.e. the bottleneck.

In order to facilitate fixing the discharge control device onto the neck of the container by means of a force fit or clipping connection (which are modes of connection which are entirely based on elastic deformation of the device and which result from the mechanical properties of the thermoplastic material in which it is made), a slight modification of the shape of the device can be made if desired. This modification can include using at least one partial, radial slit in an upper peripheral surface of the device and the design thereof would be well known to those of skill in the art.

This partial slit will advantageously close partially when the discharge control device is introduced into the neck of the container, and will return to its initial position once the device has been positioned into the container's neck, at the level of the notch and groove.

This at least one partial slit increases the capacity of reversible elastic deformation of the discharge control device during its introduction into the container's neck. The two rims of the at least one partial slit are capable of getting together during the introduction of the discharge control device into the container's neck.

The securing means makes it possible to provide a seal between the interior and the exterior of the container when the external peripheral surface of the device is not cylindrical but for example, when it has a bulge such as an olive-type bulge.

The sealing system is particularly desirable when a heat seal is not placed on the peripheral surface of the neck of the container, but rather is fixed, for example, on the only main distribution opening of the discharge control device.

The securing means also preferably comprises means which make it possible to position the device vertically in relation to the neck of the associated container, preventing the vertical movement of the latter once it is fitted, particularly in the case of a force fit.

The securing means can be formed, for example, by a flange, bearing against the neck of the container, and/or a circular housing provided in the neck of the container or the like.

The upper surface of the discharge control device inserted into the neck of the container is preferably at most flush with the peripheral surface of the neck of the container and/or bears against this surface by way of a support means. The support means can be a flange that is preferably cylindrical and advantageously has a diameter greater than the internal diameter of the neck of the container and that is at most equal to the external diameter of the neck of the container. The flange is preferably positioned at the level of the upper surface of the device.

A flange of this kind prevents the device being driven too far into the neck of the container and ensures precise vertical positioning.

A suitable securing means can also include a reverse-lock stop positioned at the level of the lower surface of the device. This prevents the device from coming out of the neck of the container onto which it is fixed.

The reverse-lock stop can be in any desired form, such as in the form of a collar or segments of a collar with a certain degree of elasticity so as to be inserted, by deformation, into the neck of the container. The stop then relaxes and acts like a non-return flap by bearing against the base of the neck of the container. This kind of elasticity and recovery of shape are ensured by the resilient material chosen to make the device and by the design of the reverse-lock stop.

Several connecting means comprising elements for securing and positioning the device onto the neck of the container can be used together at the same time if desired for any reason.

Sealing Surfaces:

According to the present invention, the discharge control device inserted into the container, i.e. connected to the container, preferably comprises a heat seal that is sealed onto at least one of the surfaces defined by:

the upper peripheral surface of the neck of the container; and/or all or part of the upper surface of the device; and/or the surface of the main distribution opening of the device.

In a first possible embodiment or configuration, the heat seal is sealed thermally onto the only upper peripheral surface of the neck of the container and is positioned in the first plane forming the first sealing surface. The discharge control device is inserted into the neck of the container, so that at least one part of its upper surface is level with the neck of the container forming the first sealing surface.

A recess on a part of the wall of the neck of the container can be provided so as to permit the positioning of the device when the latter is provided with a flange type support means, leaving a part of the thickness of the neck still available for sealing with a heat seal.

This first configuration, where the heat seal is secured onto the only upper peripheral surface of the neck of the container, can be used both for a solid structure and a thin-walled structure or any way as desired.

In a second configuration, the heat seal is sealed both onto the upper peripheral surface of the neck of the container. The neck can optionally be provided (or not) with a recess located within the first sealing surface and onto the upper peripheral surface of the device level with the neck, that is on the second sealing surface. Such an orientation is possible whether or not there is a flange bearing against the recess of the neck.

In the case of a solid structure, the upper surface of the discharge control device is preferably between the exterior diameter of the flange, if there is one, and the interior diameter of the main distribution opening. In the case of a thin-walled structure, the upper surface of the discharge control device is preferably in the form of concentric surfaces formed by the flange, if there is one, and the main distribution opening, when the latter is level with the plane of the upper surface of the device. At least one of these concentric surfaces preferably forms a sealing surface connected with the first sealing surface formed by the neck of the container.

Particularly with this second configuration, the heat seal is sealed onto the upper peripheral surface of the neck of the container. The neck is optionally provided (or not) with an annular recess. The heat seal extends onto the upper surface of the device level with the neck or the flange, when the device is provided with one, and onto the upper peripheral surface of the main distribution opening, that is the third sealing surface when it is level with the neck of the container.

In a third configuration, where the support means of the device, here a flange, has the same dimensions as the neck of the container and completely covers the upper peripheral surface of the neck, the heat seal is sealed onto the only upper surface of the device with either a solid structure or a thin-walled structure. In the case of a thin-walled structure, the heat seal can be sealed onto the only flange of the device or onto the only peripheral surface of the main distribution opening or onto both at the same time.

Particularly with this third configuration, when the main distribution opening is set back in relation to the plane of upper peripheral surface of the discharge control device, the sealing surface preferably includes only the upper peripheral surface of the flange, that is, the second sealing surface.

This third configuration (where the discharge control device bears against the neck of the container via its flange-type support means which completely covers the neck) is preferably employed when the filler of the packaging is not able to adapt the neck of the container to arrange the flange of the device by using a recess and provide a heat seal over the neck of the container. A force fit with an olive type shape, for example, makes it possible to ensure the seal of the container that is heat-sealed in this way.

A fourth configuration relates to a structure with thin walls. In such an embodiment, when the main distribution opening is positioned mostly set back in relation to the plane of the upper peripheral surface of the device, the plane of the upper peripheral surface can be closed by a heat seal sealed onto the only peripheral surface of the main distribution device, that is, onto the third sealing surface.

When the device of an assembly according to the present invention has a thin-walled structure and comprises a main distribution opening set back in relation to the plane of the upper peripheral surface of the device, it frees up a space between the main distribution opening and the heat seal once sealed. The heat seal preferably comprises a first inviolability control regardless of the retained sealing configurations.

This available space makes it possible to connect, at the level of the main distribution opening, (if desired) a second inviolability control in the form of a tearable membrane connected, on the one hand, to a gripping and traction ring and, on the other hand, to the periphery of the main distribution opening and thus seal the main distribution opening. The user can thus, in connection with a first time use, delaminate the heat seal, then tear, by means of traction on the ring, the tearable membrane, thus opening up the main distribution opening. The device equipped in this way with the tearable membrane and its gripping ring can be produced by injection and from a single material.

This available space also makes it possible if desired to connect a child safety system, instead of the second inviolability control, still at the level of the main distribution opening. A system of this kind typically comprises a membrane forming a partition above and in line with the main distribution opening and almost in contact with the upper edge of the opening. This membrane is preferably connected to the main distribution opening by a single integral pointed deformable resilient link in one piece with the device, injected in a single operation from resilient material. The membrane forming the partition is also advantageously equipped with a gripping means, making it possible for the user to exert force on the partition.

By means of the elastic deformation of the link, after effort is exerted, it is possible for the user to displace the partition, and then to open up the main distribution opening of the discharge control device. The displacement movement of the partition relative to the main distribution opening can be performed by partial angular rotation around the connecting point of the partition with the distribution opening in a vertical or horizontal axis. A movement of this kind conducted at the same time as turning the container with its heat seal removed upside down to extract the products is fairly complex, and therefore generally provides protection for young children who are not able to perform two disconnected movements simultaneously.

The thermal sealing of the heat seal onto the sealing surfaces can be achieved by means of various different known techniques, in particular induction.

Mode of Functioning

One embodiment set forth below. The mode of functioning of the storage and distribution assembly and at the time of distribution of the packaged products can comprise a situation where a user firstly removes the heat seal by peeling, ensuring the seal and inviolability of the storage and distribution assembly. The user then inverts the assembly by turning it so that the stock of products to be distributed is positioned above the distribution device and is in contact with its guiding surface.

By the action of gravity, the products to be distributed come into contact successively with the guiding surface, then with the main distribution opening whose adapted dimension permits the passage preferably of one product at a time.

Production of the Device:

The discharge control device belonging to the storage and distribution assembly according to the invention can be produced by any desired method. One possible method is one where the device preferably produced by means of injection moulding and from thermoplastic materials.

Other production techniques can also be used such as single or multilayer extrusion and sheet cutting by any extrusion technique or by calendering followed by thermoforming, then punching and cutting to obtain the device. Blow-injecting can also be considered. However, injection moulding may be a preferred method in some cases.

Known plastic materials can be used to form the device and include radical or linear high and low density polyethylenes, copolymers of ethylene such as for example ethylene vinyl acetates, ethylene ethyl acrylates, ethylene butyl acrylates, ethylene maleic anhydrides, ethylene alpha olefines, regardless of the methods of polymerisation or modification by grafting, homo polypropylene and copolymers, polybutene-1, polyisobutylene. Polyolefines are preferably selected to make the device for cost reasons and because they are easy to use.

Other polymer materials can be considered however such as polyvinyl chloride, copolymers of vinyl chloride, polyvinylidene chlorides, polystyrenes, copolymers of styrene, derivatives of cellulose, polyamides, polycarbonates, polyoxymethylenes, polyethylene terephthalates, polybutylene terephthalates, copolyesters, polyphenylene oxides, polymethyl methacrylates, copolymers of acrylate, fluoride polymers, polyphenylene sulphides, polyarylsulphones, polyaryletherketones, polyetherimides, polyimides, thermoplastic elastomers, polyurethanes, phenol resins, melamine resins, urea resins, epoxy resins and unsaturated polyester resins.

Biodegradable polymer materials, with for example a starch base, are also possible such as polylactic acids (PLA).

Combinations of these polymers can be used, if desired.

The polymer used to produce the discharge control device can also contain one or more additives such as elastomers, fibers, expanding agents, additives such as stabilizers and colorants, sliding agents, demolding agents, adhesion agents or reinforced catching agents and/or any others according to the requirements of usage.

A device according to the invention can also be made from injectable materials made in such a way that they are capable of absorbing various different pollutants such as humidity, oxygen, odour and other possible pollutants. The thermoplastic materials are thus themselves formulated with additives belonging to a group of humidity absorbers, oxygen absorbers, odour absorbers and/or emitters of volatile olfactory organic compounds. The formulated thermoplastic materials must however retain a certain degree of resilience.

An assembly comprising a storage container and discharge control device, sealed according to the present invention can optionally be equipped with a sealing means for the open end of the body of the container, which can be a stopper/cover, which is designed to ensure a seal between the body of the container and the stopper/cover once the heat seal has been pulled off.

At the time of being assembled on a packaging line or other operation, the container is first filled with the products to be distributed and this is preferably done prior to receiving the discharge control device. The reason for this is the ease of filling due to the fact that the large dimension of the opening of the container is not yet restricted by the addition of a discharge control device.

The container equipped with its discharge control device is then advantageously closed in a definitive manner by the peelable heat seal on the packaging line, and is then possibly closed by a reusable stopper.

The device belonging to the storage and distribution assembly according to the present invention can optionally be delivered (or not) to the packager with its peelable heat seal already sealed onto all or part of its upper surface. Several exemplary suitable examples of use are illustrated below but should not be considered to be limiting to the scope of the invention. In addition, the various modes of use can also be combined in part(s) if desired for any reason as well.

In a first mode of use, the container previously filled with the products to be distributed receives its discharge control device, the assembly being closed by the peelable heat seal sealed by induction onto the neck of the container so as to close the container in a sealing manner.

In a second mode of use, the container previously filled with the products to be distributed receives its discharge control device already equipped with its heat seal sealed onto the upper surface of the device, the peelable heat seal being positioned in line with the neck of the container and the sealing by induction occurring between the heat seal and the neck.

The peelable heat seal is thus adhered to the neck of the container and the upper surface of the discharge control device at the same time. The peeling takes place on the two surfaces conjointly, by traction and delamination of the deformable, flexible heat seal consisting of a sheet of aluminium, but still sufficiently resistant to tearing so as not to tear during the delamination.

In a third mode of use, the container previously filled with the products to be distributed receives its discharge control device already provided with a peelable heat seal attached securely onto the only main distribution opening.

The peelable heat seal generally comprises an external portion overhanging the annular sealing surface that is able to be gripped by the user.

An identical portion (that is preferably not sealed onto the external upper surface of the discharge control device), can also be provided if a heat seal is provided only for sealing the only main distribution opening of the discharge control device according to the present invention.

The discharge control device can also be simply mounted onto the container after filling, the container then receiving its stopper, which contains in its base the sealing peelable heat seal, the heat seal being secured by any type of clipping connection. The sealing of the heat seal by induction is then carried out through the stopper mounted in this way. According to the above configurations and as described above, sealing can be performed only at the edges of the neck and/or on all or part of the upper surface of the device or in any desired fashion.

Thus, a storage and distribution assembly of this kind can be used to distribute a stock of products to be distributed preferably unit by unit that are being stored prior to use and protected from the exterior environment.

Below is described one or more exemplary and nonlimiting embodiments of the present invention with regard to the figures.

FIG. 1 shows a cross section of the heat sealed assembly (1) comprising the storage container (2) and the discharge control device (3) with a thin-walled structure according to the invention fitted onto its container at the level of the neck (4) of the container. The device is inserted into the neck of the container such that at least a part of its upper surface is flush with the peripheral surface of the neck of the container forming the sealing plane.

On the plane of its structure the discharge control device (3) comprises an entry opening (5) oriented towards the interior of the container, a guiding surface (6), an outlet opening (7) which opens into the main distribution opening (8), the device also comprising a discontinuous, external surface (9, 10), having received a peelable heat seal (11) sealed by induction.

The sealing by induction of the peelable heat seal (11) is performed on the concentric upper surfaces (9 and 10) corresponding to the main distribution opening (8) and to the upper surface of the flange (12) positioned at the upper end of the skirt (13), that is on the second and third sealing surfaces respectively as well as on the neck (4) of the container forming the first sealing surface. The peelable heat seal (11) which can be sealed by induction can also be sealed onto the only corresponding sealing surface to the free annular zone of the neck of the container and onto the upper surface of the discharge control device forming the sealing areas (9 and 10) and onto the sealing area of the neck (4) of the container.

Figure 2:
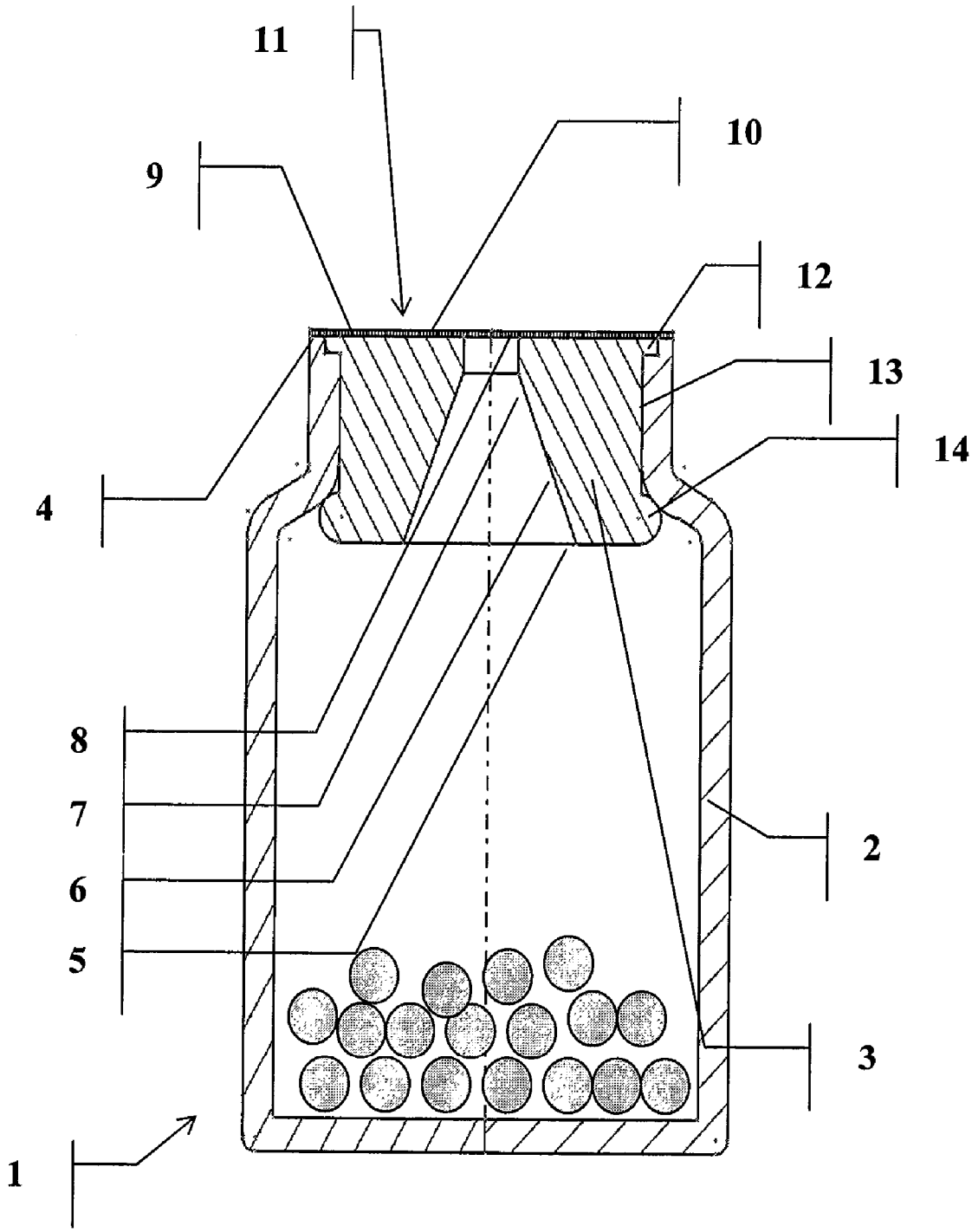
FIG. 2 shows a cross section of the sealed assembly comprising the storage container and the discharge control device with a solid structure, where the peelable heat seal has been sealed by induction onto the upper surface of the device and onto the available portion of the neck of the container.

FIG. 2 shows a cross section of the sealed assembly (1) comprising the storage container (2) and the discharge control device (3) with a solid structure, whereby the peelable heat seal (11) is sealed by induction onto the upper surface of the device (9, 10) and onto the available portion of the neck (4) of the container (2).

The device (3) is held in a non-return position by way of a peripheral protuberance (14) arranged in the lower section of the device forming the specific securing means.

The peelable heat seal (11) which is sealed by induction can also be sealed onto the only sealing surface corresponding to the free annular surface of the neck (4) of the container (2), which is the first sealing surface, and at the same time onto the upper surface of the device forming a sealing surface (9, 10) and onto the annular sealing surface of the neck (4) of the container (2).

Figure 3:
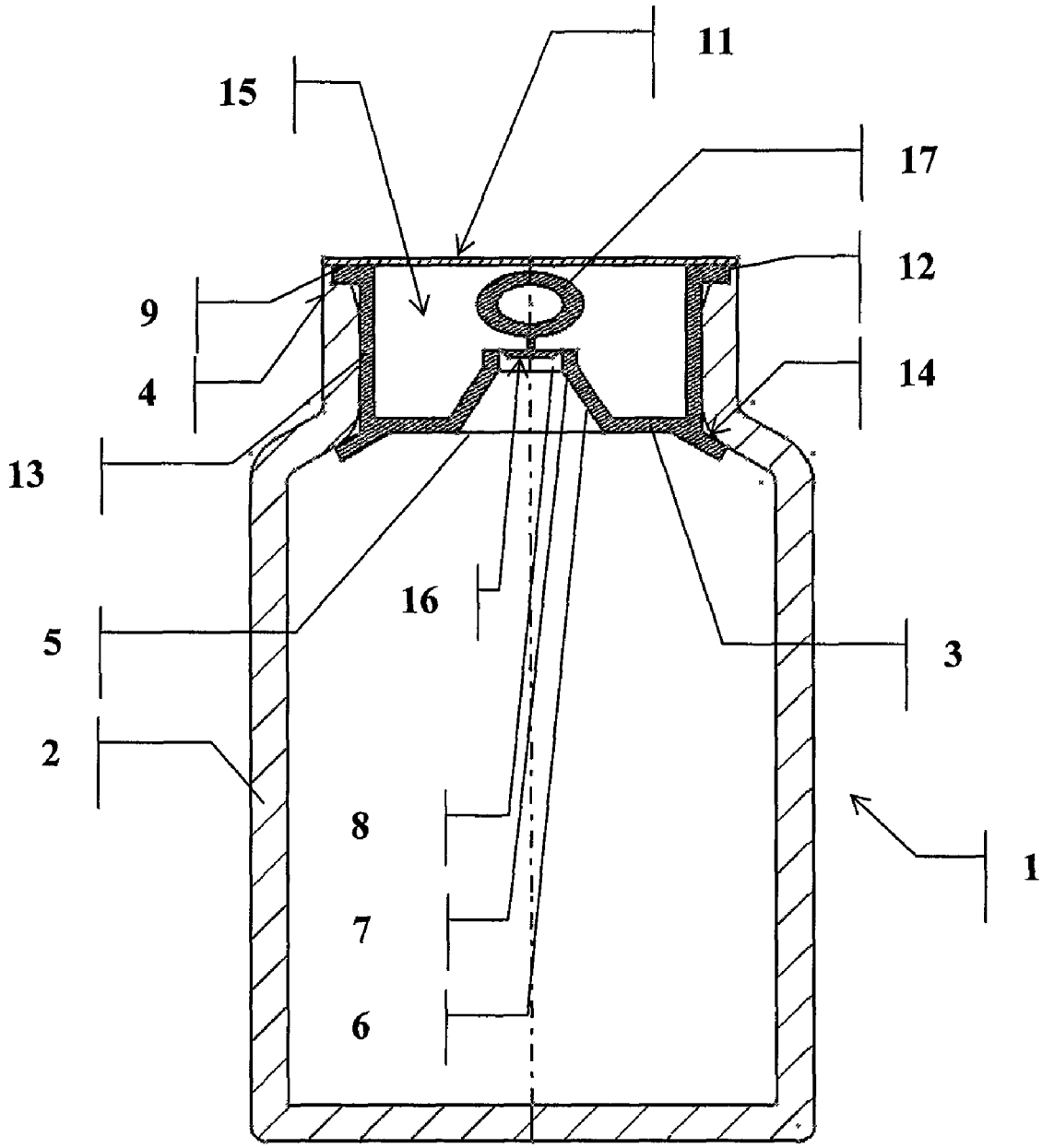
FIG. 3 shows a cross section of the sealed assembly comprising the storage container and discharge control device with a thin-walled structure according to the invention, fitted onto its container at the level of the neck of the container and sealed onto the only concentric surfaces corresponding to the upper surface of the flange, as well as on the available surface of the neck of the container, the main distribution opening being set back and permitting the installation a system with double inviolability.

FIG. 3 shows a cross section of the sealed assembly (1) comprising the storage container (2) and the discharge control device (3) with a thin-walled design according to the invention. The sealing by induction of the peelable heat seal (11) is performed on the concentric surfaces corresponding to the upper peripheral surface of the device, that is on its flange (9) and on the upper peripheral surface of the neck (4) of the container, representing the second and the first sealing surface respectively.

There is space (15) available between the heat seal (11) and the end of the main distribution opening (8) which makes it possible to connect the main distribution opening (8) with an inviolability means (16, 17) in the form of a tearable membrane (16) covering the opening and connected to a traction ring (17) which makes it possible to tear the membrane (16) and thus open the main distribution opening (8).

The device (3) is held in a non-return position by way of a peripheral protuberance (14) arranged in the lower part of the device (3).

Figure 4:
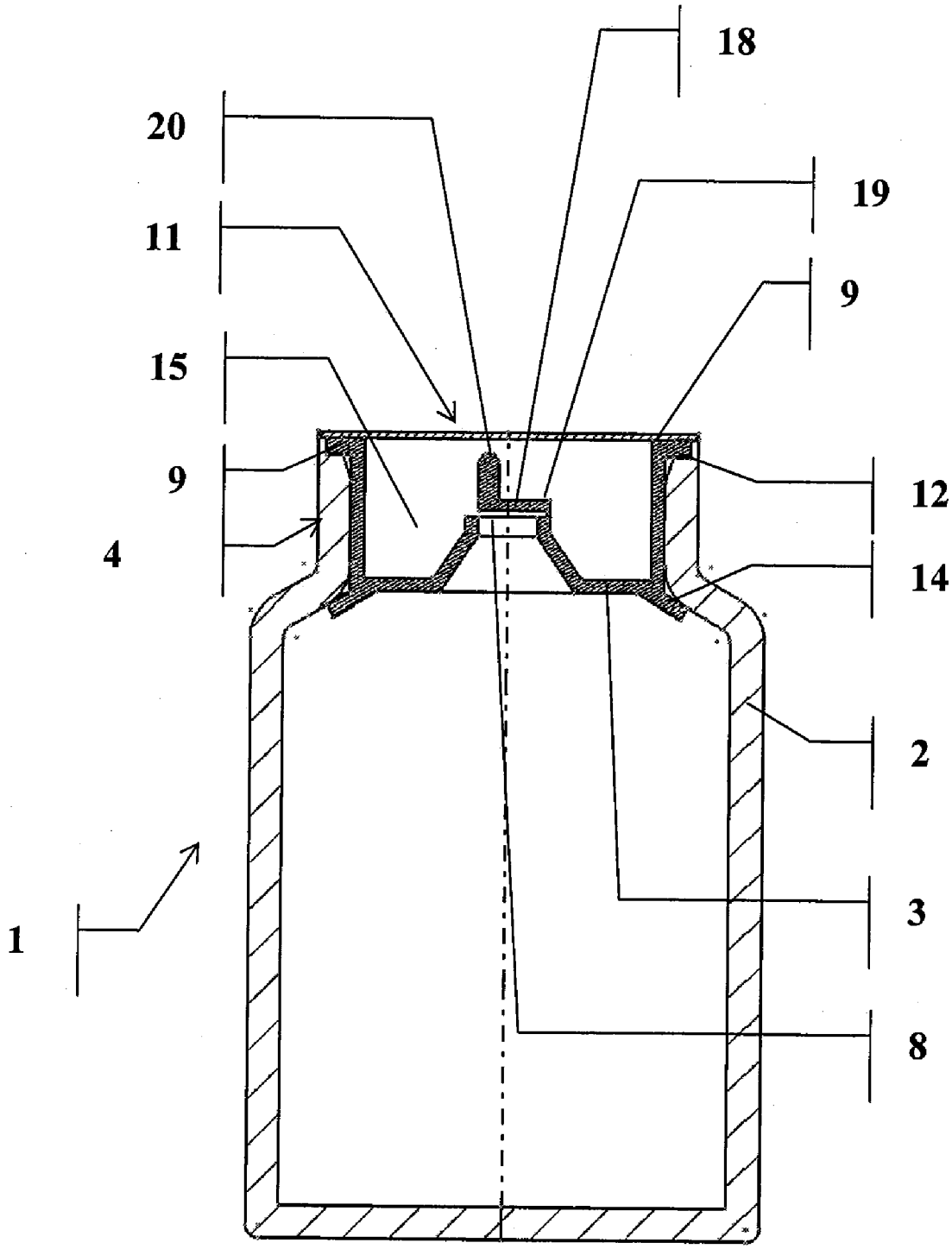
FIG. 4 shows a cross section of the sealed assembly identical to FIG. 3 but in which the system with double inviolability has been replaced by a child safety system.

FIG. 4 shows a cross section of the sealed assembly (1) comprising the storage container (2) and the discharge controlling device (3) with a thin-walled structure, according to the invention, fitted onto the container (2) at the level of the neck (4) of the container (2) in an identical manner to the example described in FIG. 3. The sealing by induction of the peelable heat seal (11) is performed in the same manner, that is on the only concentric surfaces corresponding to the upper peripheral surface of the flange (9) as well as on the upper peripheral surface of the neck (4) of the container.

There is space (15) available between the heat seal (11) and the end of the main distribution opening (8) which makes it possible to connect with the opening (8) a child protection system (18, 19, 20). This system comprises a membrane forming a partition (18) above the main distribution opening (8) of the discharge control device (3) and connected to the opening (8) by a resilient integral link (19) and is also equipped with a gripping means (20).

The device (3) is held in a non-return position by means of a peripheral protuberance (14) arranged in the lower part of the device (3).

Figure 5:
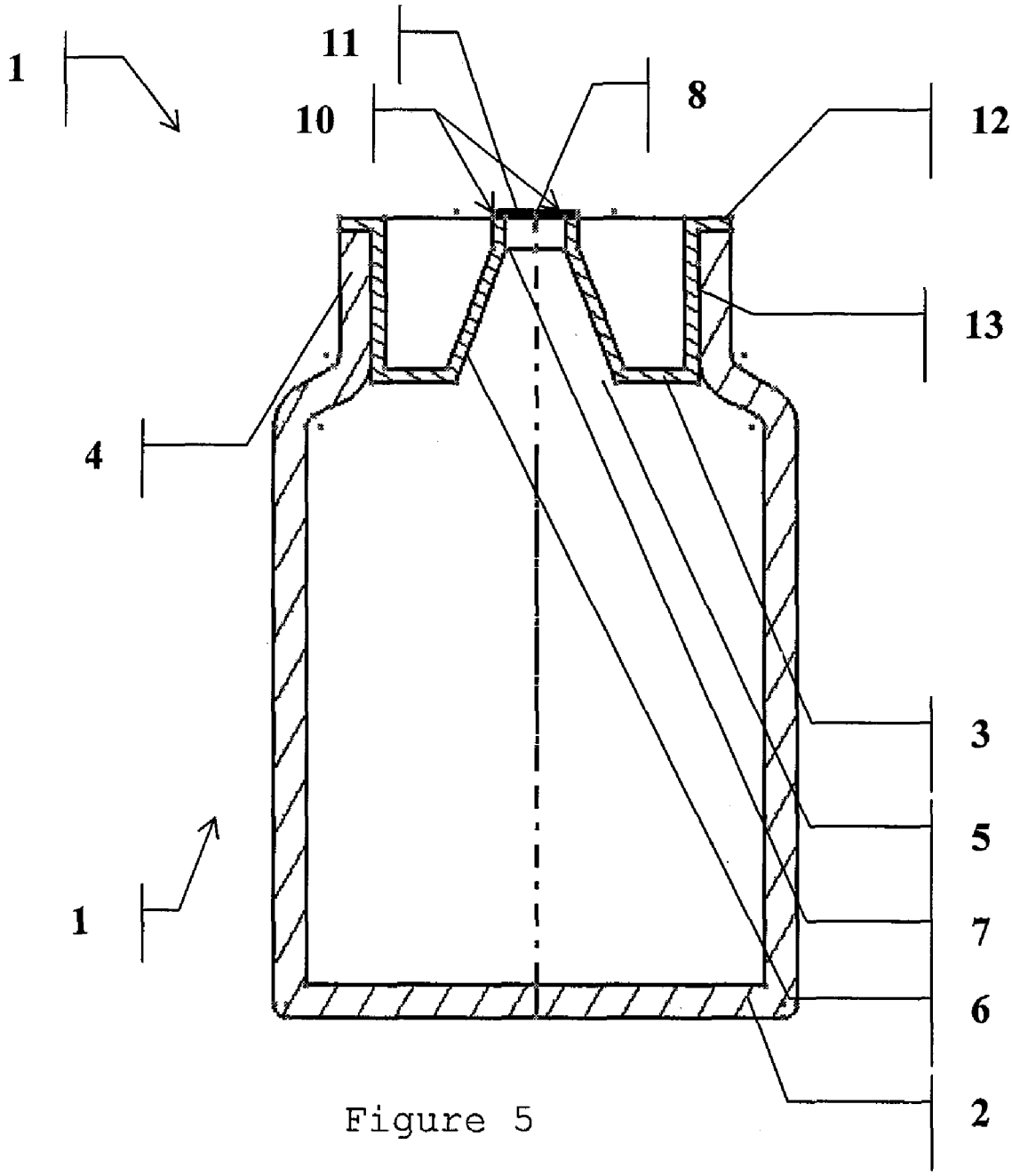
FIG. 5 shows a cross section of the sealed assembly comprising the storage container and the discharge control device with a thin-walled structure according to the invention fitted into its container at the level of the neck of the container being sealed at the only level of its main distribution opening by the peelable heat seal.

FIG. 5 shows a cross section of the sealed assembly (1) comprising the storage container (2) and the discharge control device (3) with a thin-walled structure. The assembly (1) is sealed by the peelable heat seal (11) at the only level of the peripheral surface (10) of the main distribution opening (8), that is the third sealing surface.

The device (3) belonging to the storage and distribution assembly (1) according to the invention comprises a main distribution opening (8) preceded by at least one guiding surface (6), with a line of symmetry, the surface (6) having an entry opening (5) which is the large base turned towards the interior of the container and an outlet opening (7) which opens into the main distribution opening (8).

The device belonging to the storage and distribution assembly (1) according to the invention comprises an external peripheral surface (13) forming a skirt with a force fit means for securing onto the neck (4) of the container ensuring the seal.

The device belonging to the storage and distribution assembly (1) is supported against the neck (4) of the container by means of its flange (12). The force fit between the external peripheral surface of the device and the internal peripheral surface of the neck (4) of the container makes it possible to ensure a seal between the container (2) and the exterior, once the main distribution opening (8) has been sealed on the sealing surface (10) by the peelable heat seal by induction (11).

Figure 6:
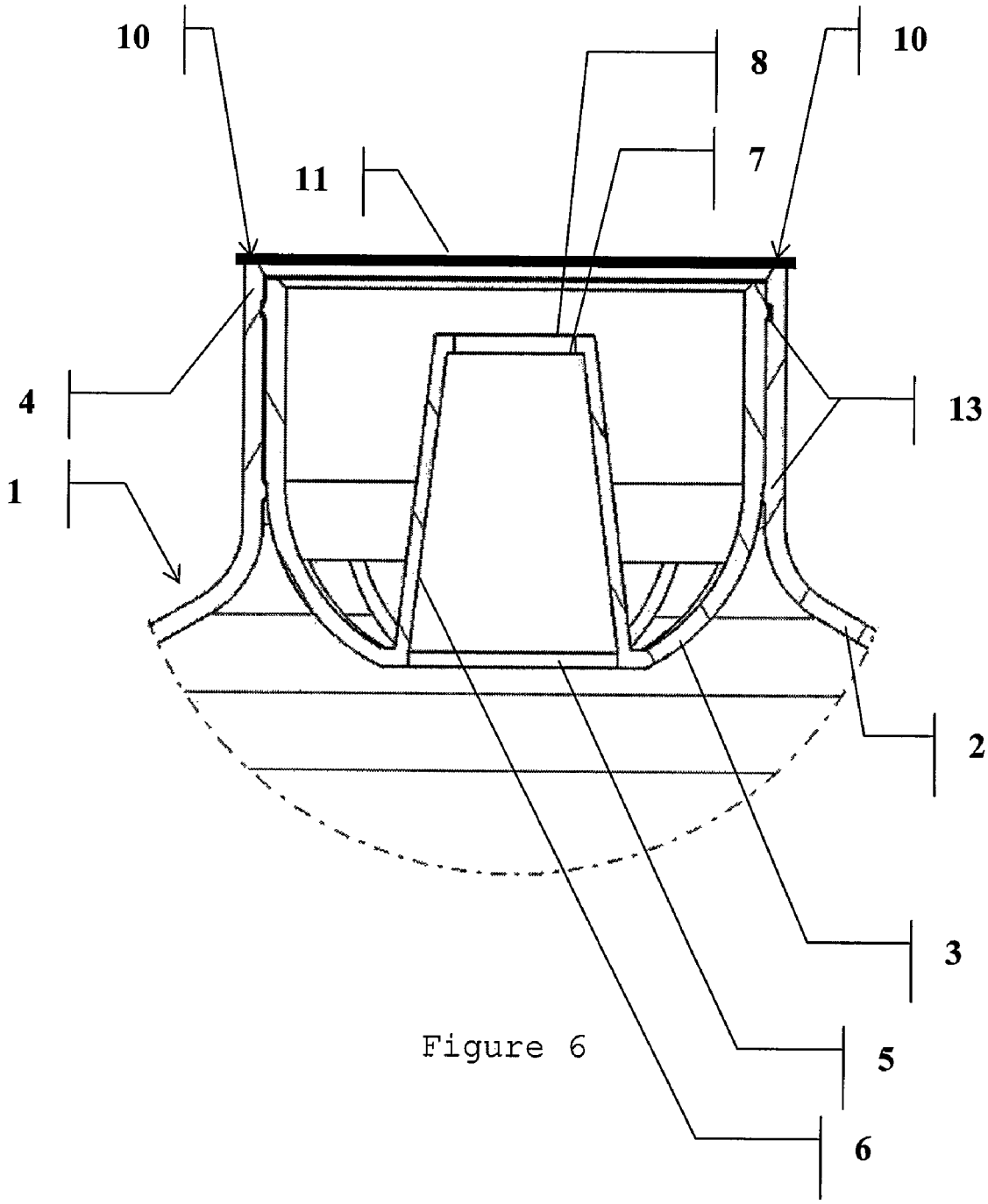
FIG. 6 shows a cross section of the sealed assembly comprising the storage container, shown in part, the discharge control device with a thin-walled design according to the invention, whereby the guiding surface is conical and bears against a hemispherical surface, and comprising a central main distribution opening and secondary openings opening into the main distribution opening.

FIG. 6 shows a cross section of the heat seal assembly (1) comprising the storage container (2), shown partially, the discharge control device with a thin-walled structure according to the invention, where the guiding surface (6) is truncated and bears against a hemispherical surface, and comprising a central main distribution opening (8) and secondary openings opening into the main distribution opening.

The device belonging to the assembly for storage and distribution (1) is inserted into the neck (4) of the container. A force fit between the external peripheral surface of the device and the internal peripheral surface of the neck (4) of the container makes it possible to provide a seal between the container (2) and the exterior. The vertical positioning of the device in relation to the neck (4) of the container is ensured by securing means (13), in the form of two recesses formed in the neck of the container into which two equivalent notches on the external skirt of the device are inserted. The peelable heat seal which can be sealed by induction (11) is sealed onto the sealing surface (10) consisting of the upper annular edge of the neck (4) of the container, i.e. the first sealing surface.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

The use of singular article terms including "an", "a" and "the" can connote the singular or plural of the object that follows.

The invention claimed is:

1. An assembly adapted for storage and controlled distribution of unitary products, said assembly comprising a container for loosely storing the products, a means for closing the container, and a device for controlling the rate of distribution of the products, said device comprising an upper surface and a lower surface and further comprising the following to permit the passage of the products to be distributed from an interior portion of the container to an exterior portion thereof:

an entry opening, on a lower surface of said device;

a guiding surface for the products to be distributed between the lower surface and the upper surface;

a distribution opening on the upper surface;

a means for securing said device onto the container;

Wherein a) the device is inserted into the container in such a way that at least a part of said upper surface is approximately flush with an upper peripheral surface of a neck portion of the container forming the sealing plane, or said device bears against the peripheral surface of said neck via a support means, the upper surface of which forms a sealing plane; b) wherein the means for closing the container comprises a heat seal fixed to the container on at least one sealing surfaces defined by:

an upper peripheral surface of a neck portion of the container; and/or all or part of the upper surface of the device; and/or peripheral surface of the distribution opening of the device, and c) wherein if said device comprises thin walls, and if the distribution opening is set back in relation to the plane formed by the upper peripheral surface of the neck of the container, then said heat seal is sealed on a peripheral surface of the distribution opening.

2. An assembly for storage and distribution according to claim 1, wherein the entry opening of the discharge control device has a profile that is substantially the same as an internal profile of the neck portion of the container.

3. An assembly for storage and distribution according to claim 1, wherein the guiding surface of the discharge control device has a truncated surface, said surface being concave with a rectilinear revolution.

4. An assembly for storage and distribution according to claim 1, wherein the guiding surface comprises a plane surface comprising the distribution opening.

5. An assembly for storage and distribution according to claim 1, wherein the distribution opening is positioned in the plane of the upper surface of the device and at any point of said plane.

6. An assembly for storage and distribution according to claim 5, wherein the distribution opening is in an axis line of the device.

7. An assembly for storage and distribution according to claim 1, wherein the distribution opening is positioned in a plane set back from a plane of the upper surface of the device.

8. An assembly for storage and distribution according to claim 7, wherein the set back distribution opening is positioned at any point of the set back plane relative to the plane of the upper surface of the device.

9. An assembly for storage and distribution according to claim 7, wherein the main set back distribution opening is positioned in a line of symmetry of the device.

10. An assembly for storage and distribution according to claim 1, wherein the means for securing the discharge control device is positioned on an external peripheral surface of the device.

11. An assembly for storage and distribution according to claim 10, wherein the means for securing the discharge control device is a force fit connection, and/or a clipping connection with notch and groove.

12. An assembly for storage and distribution according to claim 11, wherein said means for securing the discharge control device is a force fit connection and/or a clipping connection with notch and groove, and wherein said assembly includes at least one partial, radial slit in an upper peripheral surface thereof.

13. An assembly for storage and distribution according to claim 11, wherein the means for securing the discharge control device comprises a support means enabling vertical positioning of the device in relation to the neck portion of the container, said support means being a flange bearing against the neck portion of the container or placed in a circular housing provided in the neck portion of the container.

14. An assembly for storage and distribution according to claim 1, wherein the securing means of the discharge control device comprises reverse-lock means comprising a back stop positioned at a level of a lower surface of the device.

15. An assembly for storage and distribution according to claim 14, wherein the back stop is in the form of a collar and/or segments of a collar.

16. An assembly for storage and distribution according to claim 7, wherein the distribution opening is set back in relation to the plane of the upper surface of the device frees up a space below said upper surface.

17. An assembly for storage and distribution according to claim 16, wherein an inviolability system of the distribution opening is placed in said space.

18. An assembly for storage and distribution according to claim 17, wherein the inviolability system comprises a tearable membrane provided with a gripping ring that is capable of closing the distribution opening.

19. An assembly for storage and distribution according to claim 16, wherein a child safety system is arranged in said space.

20. An assembly for storage and distribution according to claim 19, wherein the child safety system comprises a membrane forming a partition positioned just above the distribution opening and connected to said opening by a resilient deformable point.

21. An assembly for storage and distribution according to claim 20, wherein the membrane forming the partition can be displaced by rotation about the resilient deformable point by movement exerted on a gripping element connected to said membrane forming the partition, thus freeing the main distribution opening.

22. An assembly for storage and distribution according to claim 1, wherein the heat seal is sealed onto an upper peripheral surface of the neck portion of the container and the neck portion is optionally provided with a recess formed therein.

23. An assembly for storage and distribution according to claim 1, wherein the heat seal is sealed onto an upper peripheral surface of the neck portion of the container, the neck portion being optionally provided with a recess said heat seal further being provided on an upper surface of the device flush with the neck portion.

24. An assembly for storage and distribution according to claim 1, wherein the heat seal is sealed onto an upper peripheral surface of the neck portion of the container, the neck portion being optionally provided with a recess, said heat seal further being provided on an upper surface of the device flush with the neck portion and on a peripheral surface of the distribution opening when said opening is flush with the neck portion of the container.

25. An assembly for storage and distribution according to claim 1, wherein the heat seal is only sealed onto the upper surface of the device, said device comprising a solid structure or comprising thin walls, said device further comprising a flange that completely covers an upper peripheral surface of said neck portion of said container.

26. An assembly for storage and distribution according to claim 13, wherein the heat seal is sealed onto said flange and/or only a peripheral surface of the distribution opening.

27. An assembly for storage and distribution according to claim 1, wherein the discharge control device has been produced by injection from thermoplastic materials.

28. An assembly for storage and distribution according to claim 1, wherein the discharge control device is made by injection of thermoplastic materials optionally formulated with at least one additive selected from the group consisting of humidity, oxygen or odor absorbers and emitters of volatile olfactory organic compounds.

* * * * *